US005976272A

United States Patent [19]

Seidel et al.

[11] Patent Number: 5,976,272

[45] Date of Patent: Nov. 2, 1999

[54] NO-RINSE PHOSPHATING PROCESS

[75] Inventors: Reinhard Seidel, Monheim; Bernd Mayer, Duesseldorf; Melanie Joppen, Niederkruechten; Melitta Krause, Duesseldorf; Joerg Riesop, Kerpen, all of Germany

[73] Assignee: Henkel Kommanditgesellschaft auf Aktien, Duesseldorf, Germany

[21] Appl. No.: 08/809,606

[22] PCT Filed: Sep. 14, 1995

[86] PCT No.: PCT/EP95/03619

§ 371 Date: Mar. 24, 1997

§ 102(e) Date: Mar. 24, 1997

[87] PCT Pub. No.: WO96/09422

PCT Pub. Date: Mar. 28, 1996

[30] Foreign Application Priority Data

Sep. 23, 1994 [DE] Germany ..... 44 33 946

[51] Int. Cl.[6] ..... C23C 22/07

[52] U.S. Cl. ..... 148/261; 148/262; 148/263

[58] Field of Search ..... 148/259, 262, 148/261, 263, 253

[56] References Cited

U.S. PATENT DOCUMENTS

| | | | |
|---|---|---|---|
| 3,819,425 | 6/1974 | De Ridder et al. | 148/256 |
| 3,939,014 | 2/1976 | Reed | 148/6.15 Z |
| 4,142,917 | 3/1979 | Yashiro et al. | 148/6.16 |
| 4,264,378 | 4/1981 | Oppen et al. | 148/6.15 R |
| 4,316,751 | 2/1982 | Prescott et al. | 148/6.15 Z |
| 4,824,490 | 4/1989 | Oei et al. | 148/259 |
| 4,950,339 | 8/1990 | Gehmecker et al. | 148/262 |
| 5,047,095 | 9/1991 | Geke et al. | 148/259 |

FOREIGN PATENT DOCUMENTS

| | | |
|---|---|---|
| 0 015 020 | 9/1980 | European Pat. Off. . |
| 0 038 097 | 10/1981 | European Pat. Off. . |
| 0 042 631 | 12/1981 | European Pat. Off. . |
| 0 141 341 | 5/1985 | European Pat. Off. . |
| 0 269 138 | 6/1988 | European Pat. Off. . |
| 0 565 346 | 10/1993 | European Pat. Off. . |
| 2 365 642 | 4/1978 | France . |
| 25 52 122 | 5/1976 | Germany . |
| 27 39 066 | 3/1978 | Germany . |
| 42 41 134 | 6/1994 | Germany . |
| 50 -139 039 | 11/1975 | Japan . |
| 2 148 950 | 6/1985 | United Kingdom . |

OTHER PUBLICATIONS

"Characteristiques de la Phosphation sans Rincage", Surfaces 106 (1976), No. 15, pp. 25–28.

*Primary Examiner*—John Sheehan
*Assistant Examiner*—Andrew L. Oltmans
*Attorney, Agent, or Firm*—Ernest G. Szoke; Wayne C. Jaeschke; Daniel S. Ortiz

[57] ABSTRACT

A process for phosphating metal surfaces by treatment with an acidic zinc- and phosphathe-containing solution which does not require rinsing. The metal substrate is contacted with a phosphating solution containing 2 to 25 g/l of zinc ions, 2 to 25 g/l of manganese ions and 50 to 300 g/l of phosphate ions. The solution has a pH value of 1 to 3.6, a free acid content of 0 to 100 points, a total acid content of 40 to 400 points and a ratio of free acid to total acid of 1:4 to 1:20.

19 Claims, No Drawings

NO-RINSE PHOSPHATING PROCESS

BACKGROUND OF THE INVENTION

1. Field of the Invention

This invention relates to a phosphating solution and to a process for phosphating surfaces of steel, zinc, aluminium or their alloys. It is particularly suitable for phosphating electrolytically galvanized or hot-dip-galvanized steel. After the intended contact time on the surfaces, the phosphating solutions are not rinsed off with water, but instead are immediately dried on the lines of a so-called no-rinse process. Accordingly, the process according to the invention is particularly suitable for use in continuous strip treatment plants.

The object of phosphating metals is to produce on the metal surface firmly intergrown metal phosphate coatings which improve resistance to corrosion and, in conjunction with paints and other organic coatings, lead to a significant increase in paint adhesion and in resistance to creepage in corrosive environments. Phosphating processes have long been known. Recently, low-zinc phosphating processes where the phosphating solutions have comparatively low contents of zinc ions, for example of 0.5 to 2 g/l, have been particularly preferred for pretreatment in preparation for painting, more particularly electrolytic dip coating as normally applied in the automotive industry.

In the automotive industry and, in particular, in the domestic appliance industry, but also for architectural applications, there has been a tendency to use galvanized steel strip pre-phosphated in the steel mill in order to utilize the more favorable forming properties of phosphate-coated strip and to save on chemical treatment steps before painting. Accordingly, increasing importance is being attached to phosphating processes which lead to high-quality phosphate coatings despite the short phosphating times of the strip mill of only a few seconds. The treatment is normally carried out by spraying, by immersion or by combined spraying/immersion, the phosphating solution being rinsed off from the metal surface with water after the required contact time. One such process is described, for example, in DE-A-42 41 134, according to which phosphating solutions containing 1.0 to 6.0 gl of zinc and 8 to 25 g/l of phosphate are used. Other optional components are nickel, cobalt, manganese, magnesium and calcium each in quantities of 0.5 to 5.0 g/l, iron(II) in quaintities of up to 2 g/l and copper in quantities of 3 to 50 mg/l.

2. Related Art

The hitherto necessary removal of the phosphating solution by rinsing off with water leads on the one hand to a high consumption of fresh water in the phosphating plant and, on the other hand, results in the accumulation of wastewater contaminated with heavy metals which has to be treated for reuse or for discharge into the main drains. The concept of no-rinse phosphating has already been discussed in the literature (G. Carreras-Candi: "Characteristiques de la Phosphatation sans Rincage" . . . , Surfaces 106 (1976), Number 15, pages 25–28) without any concrete information on how the process is carried out or on suitable treatment baths.

DE-C-27 39 006 describes a phosphating process which eliminates the need for rinsing with water which is undesirable from the environmental and cost point of view. In this process, the surfaces are contacted for 1 to 5 seconds at 50 to 75° C. with a phosphating solution which contains 0.1 to 5 g/l of zinc, 1 to 10 parts by weight of nickel and/or cobalt per part by weight of zinc, 5 to 50 g/l of phosphate and—as accelerator—0.5 to 5 g/l of hydrogen peroxide. The surfaces are immediately dried without rinsing. The use of phosphating solutions containing more than 5 g/l of zinc is discouraged because they have an adverse effect on paint adhesion.

EP-B-141 341 also describes a no-rinse phosphating process. This process was developed in particular for fixed structures, such as bridges or the like. Accordingly, the surfaces to be protected are treated with a solution containing 1 to 5% by weight of zinc, 1 to 20% by weight of phosphoric acid, 0.01 to 0.5% by weight of cobalt and/or nickel and 0.02 to 1.5% by weight of an accelerator. After application of the phosphating solution, for example by wiping, brushing, spread coating, roll coating or spray coating, the solution is left to act for an unspecified time, the solution either reacting out or only partly reacting. In both cases, the surfaces can be rinsed after exposure to the phosphating solution.

In contrast to conventional phosphating processes which are used in preparation for painting, the phosphating solution described above has high zinc and phosphate contents. Phosphating solutions in similar concentration ranges are also known for the deposition of phosphate coatings onto metal parts which are to be subjected to cold mechanical forming, for example by drawing or pressing. The relatively thick phosphate coatings deposited, which may be impregnated with oil to enhance their effect, act as lubricants and reduce friction between tool and workpiece. They are not normally suitable as a pretreatment before painting because paint adhesion to the thick phosphate coatings under mechanical stressing is very poor. A corresponding phosphating solution which may be used to form phosphate coatings on steel strip or steel wire, acting as a lubricant before cold drawing or other forming processes, is described for example in DE-B-25 52 122. According to this document, the solutions used contain zinc in a quantity of 5 to 100 g/l and phosphate in a quantity of 10 to 150 g/l and—as accelerator—nitrate in a quantity of 10 to 80 g/l. The phosphating solution is brought into contact with the surface for 5 to 15 seconds and then rinsed off with water.

The problem addressed by the present invention was to provide phosphating processes and phosphating solutions which are intended for use in continuous strip mills and which eliminate the need to rinse the treated surfaces with water.

BRIEF DESCRIPTION OF THE INVENTION

In a first embodiment, the present invention relates to a process for phosphating surfaces of steel, zinc, aluminium or their alloys by treatment with acidic zinc- and phosphate-containing solutions and drying the solutions without rinsing, characterized in that the surfaces are contacted with a phosphating solution which contains 2 to 25 g/l of zinc ions and 50 to 300 g/l of phosphate ions and which have a pH value of 1 to 4.

DETAILED DESCRIPTION OF THE INVENTION

Zinc concentrations of 5 to 25 g/l are preferred insofar as they provide for increased process safety. If corrosion control does not have to meet overly stringent requirements, as for example in the domestic appliance field, it is sufficient to use zinc as sole layer-forming cation. For improved corrosion control, as required for example in automobile manufacture, it is preferred to use a phosphating process in which the phosphating solution additionally contains 2 to 25 g/l and preferably 5 to 25 g/l of manganese ions. In addition to or instead of the manganese ions, the phosphating solution may contain other components to optimize the properties of the phosphate coating for the intended application of the pretreated material. For example, the phosphating solution may additionally contain one or more divalent metal ions in quantities of 0.1 to 15 g/l, these additional metal ions preferably being selected from nickel, cobalt, calcium and magnesium. In addition, the phosphating solution may contain iron in quantities of 0.01 to 5 g/l and/or 3 to 200 mg/l of copper ions. Depending on the substrate, additions of fluoride in free or complexed form, for example as fluoro complexes of boron, silicon, titanium or zirconium, can have a favorable effect on layer formation. This is particularly the case in the phosphating of hot-dip-galvanized steel. The effective quantities of fluoride are between 0.01 and 5 g/l. At pH values above 3, which can be of advantage in the surface treatment of electrolytically galvanized steel, the phosphating solutions tend to become unstable. They can be stabilized by addition of 0.1 to 100 g/l of a chelating hydroxycarboxylic acid containing 3 to 6 carbon atoms. Examples of such hydroxycarboxylic acids are lactic acid and, in particular, citric acid and tartaric acid.

The free acid content of the phosphating solution is preferably in the range from 0 to 100 points. The free acid point count is determined by titrating 10 ml of the phosphating solution with 0.1 N sodium hydroxide to a pH value of 3.6. The consumption of sodium hydroxide in ml indicates the free acid point count. If the phosphating solution already has a pH value of 3.6, the free acid point count is thus 0. Conversely, at higher pH values, the phosphating solution is titrated with 0.1 N hydrochloric acid to a pH value of 3.6. The free acid point count is thus negative and is equated with the consumption of hydrochloric acid in ml provided with a negative symbol. The total acid content is determined by titrating 10 ml of the phosphating solution with 0.1 N sodium hydroxide to a pH value of 8.5. The consumption of 0.1 N sodium hydroxide in ml indicates the total acid point count. For the phosphating solution according to the invention, the total acid content is preferably in the range from 40 to 400 points. The ratio of free acid to total acid is preferably adjusted to lie in the range from 1:4 to 1:20.

Phosphating solutions with a temperature of 15 to 80° C. and, more particularly, 20 to 40° C. are preferably used. The active substance content of the phosphating solutions should be in the range from about 5.5 to about 35% by weight. The active substance content is defined as the sum of metal ions, phosphoric acid and any of the other components mentioned.

The process according to the invention is particularly designed for phosphating travelling metal strips in strip treatment plants as encountered, for example, in steel mills. A liquid film coating of 2 to 10 ml of phosphating solution per $m^2$ of metal surface is preferably applied to the surfaces. The optimum value for the liquid film coating is determined, on the one hand, by the active substance content of the phosphating solution and, on the other hand, by the plant-specific contact time of the phosphating solution. At the strip speeds of 10 to 300 m/minute normally encountered at the present time, weights of the phosphate coatings of around 0.3 to around 3 $g/m^2$, as required for subsequent painting, are obtained with liquid film coatings of around 6 $ml/m^2$. In general, the concentrations of the phosphating solution should be higher, the smaller the liquid film coating.

Application of the phosphating solution to the surface and adjustment of the required liquid film coating can be carried out in various ways. For example, the phosphating solution may be sprayed onto the surface in such a way that the required liquid film coating is established. However, greater process safety is achieved if the liquid film coating is specifically adjusted after the phosphating solution has been sprayed on, for example by blowing with compressed air or preferably by squeezing rollers. Instead of being sprayed on, the phosphating solution may also be applied to the surface by applicator rolls, in which case the required liquid film coating can be directly adjusted. Applicator rolls are known for the surface treatment of metal strips, for example under the name of "chemcoater" or "roll coater". In addition, the process may be carried out in such a way that the surfaces dip into the phosphating solution. Metal strips may be passed, for example, through the phosphating solution, the required liquid film coating being adjusted on the surface after the strip has left the phosphating solution, for example by blowing with air or preferably by means of squeezing rollers.

The optimum process parameters are dependent upon the specific material properties of the surfaces to be treated. For example, it has been found that, in the treatment of surfaces of travelling strips of hot-dip-galvanized steel, optimal phosphating results are obtained when the phosphating solution has an active substance content of 5.5 to 35% by weight. The preferred pH value is in the range from 1.0 to 2.2 and the ratio by weight of the sum of the divalent metal ions to phosphate is preferably adjusted to a value of 1:5 to 1:6.

In the treatment of hot-dip-galvanized steel, the presence of free or complexed fluoride in the phosphating solution has a favorable effect on layer formation. Fluoride concentrations of 0.5 to 1.5 g/l are particularly effective. Free fluoride is preferably used in the form of hydrofluoric acid while complex fluorides are preferably used in the form of fluoro acids of boron, silicon, titanium and/or zirconium. Alkali metal fluoride or acidic alkali metal fluorides, such as $KHF_2$, may also be used to make free fluoride available.

By contrast, in the treatment of surfaces of travelling strips of electrolytically galvanized steel, the best results are obtained when the following conditions are established: an active substance content of the phosphating solution of 5.5 to 20% by weight, a pH value of 1.5 to 3.5, a ratio by weight of the sum of divalent metal ions to phosphate of 1:5 to 1:6. Phosphating solutions with these bath parameters tend to become unstable, particularly if the pH value is adjusted in the upper half of the range mentioned. The stability of the bath can be improved by addition of around 1 to 5% by weight of a chelating hydroxycarboxylic acid containing 3 to 6 carbon atoms, for example lactic acid and, preferably, citric acid and/or tartaric acid.

In the treatment of surfaces of travelling strips of cold-rolled, ungalvanized steel, the following conditions are preferably established: an active substance content of the phosphating solution of 5.5 to 25% by weight, a pH value of 2.0 to 4.0, a ratio by weight of the sum of the divalent metal ions to phosphate of 1:5 to 1:6. In this case, too, bath stability can be improved by addition of around 1 to 10% by weight of a chelating hydroxycarboxylic acid containing 3 to 6 carbon atoms, for example lactic acid and, preferably, citric acid and/or tartaric acid.

There is no need to use so-called accelerators, i.e. substances which promote layer formation by virtue of their oxidizing or reducing effect, particularly in the treatment of galvanized steel. However, it can afford advantages where the development of certain crystal forms is required. Suitable accelerators are any of the compounds known from the relevant prior art, more particularly nitrate, nitrite, chlorate, nitrobenzene sulfonic acid or hydrogen peroxide. Hydroxylamine may be used as an accelerator with more of a reducing effect. Hydrogen peroxide and hydroxylamine may be used as such whereas the other accelerators mentioned may be used as free acids or in the form of salts soluble in the phosphating solution. However, since only a small quantity of water-soluble salts, if any, should remain behind on the surface after the phosphating solution has dried, it is advisable to avoid alkali metal and ammonium salts and also sulfates. Accelerators which do not leave salt-like residues behind on the treated surfaces are particularly preferred. Accordingly, hydroxylamine and, in particular, hydrogen peroxide are particularly suitable. Where accelerators are used, their preferred concentrations are from 2 to 5 g/l for hydroxylamine, nitrobenzene sulfonic acid and chlorate, from 0.2 to 1 g/l for nitrite and from 20 to 100 ppm for $H_2O_2$.

According to the invention, the liquid film remaining on the surface after application of the phosphating solution is not rinsed off, but instead is dried. To this end, the surfaces are preferably heated to a temperature of 50 to 120° C. and more preferably to a temperature of 60 to 90° C. Various possibilities are available in this regard. For example, the treated steel strip may be passed through a drying oven heated to the corresponding temperature. However, drying may also be carried out by blowing hot gases, preferably air, onto the surfaces and/or by exposing the surfaces to infrared radiation. Since the acidic phosphating solution can react chemically with the metal surface as long as it is still liquid, the effective contact time is defined as the time elapsing between the first contact of the surface with the phosphating solution and the complete drying of the liquid film on the surface, i.e. the end of the drying step. This time is preferably between about 3 and about 60 seconds.

Under the process conditions mentioned, phosphate coatings with a weight of 0.3 to 3 g/m$^2$ are produced on the surfaces. Coating weights of this order are particularly desirable as a basis for subsequent painting because the two requirements of corrosion control and paint adhesion are both satisfied to a particular degree in this way. Depending on how the process is carried out, coatings are obtained which do not yield any reflexes in X-ray diffraction studies, i.e. may be regarded as X-ray amorphous, or which show more or less pronounced reflexes of hopeite.

The strips prephosphated by the process according to the invention may be used in particular in the manufacture of automobiles. It is standard practice in this regard to rephosphate and then paint the bodies (normally by cathodic electrodeposition coating) after assembly. In these cases, the material prephosphated by the process according to the invention is transported in the unpainted state to the further processor. To improve temporary corrosion control during storage and transportation, the phosphated material may be additionally oiled. Subsequent forming operations are also made easier in this way. Rephosphating of the assembled bodies after alkaline cleaning is readily possible.

However, phosphating in accordance with the invention may also be immediately followed by coating of the strip with an organic film or a lacquer. This process is known as coil coating. Coil-coated material is at present mainly used in the manufacture of domestic appliances such as, for example, refrigerators and washing machines and also for architectural applications.

In the prior art, it is standard practice for phosphating to be preceded by so-called activation. The object of activation is to allow crystal nuclei for the formation of the phosphate coating to form on the metal surface. The formation of dense, small-crystal phosphate coatings is promoted in this way. At present, aqueous solutions or suspensions of titanium phosphates are exclusively used for activation. The process according to the invention may also be preceded by an activating treatment. The activating treatment may be carried out with commercially available titanium phosphate activators such as, for example, Fixodine® 950, a product of Henkel KGaA. Where the process according to the invention is preceded by an activating treatment, it is advisable to dry the strip between activation and phosphating.

In another embodiment, the present invention relates to a zinc- and manganese-containing aqueous acidic phosphating solution for phosphating surfaces of steel, zinc, aluminium or their alloys, characterized in that it contains 2 to 25 g/l of zinc ions, 2 to 25 g/l of manganese ions and 50 to 300 g/l of phosphate ions and has a pH value of 1 to 4.

In addition, the phosphating solution may contain one or more of the other components mentioned above in the description of the process. Similarly, the conditions mentioned above also apply to the preferred contents of Zn, Mn and any other metal ions, to the free acid and total acid contents and to the preferred ratio of free acid to total acid.

EXAMPLES

Steel plates of the ST 1405 quality, steel plates electrolytically galvanized on both sides (ZE) with a zinc coating of 7.5$\mu$ and steel plates hot-dip-galvanized on both sides (Z) with a zinc coating of around 10$\mu$ were used for the laboratory testing of the phosphating process according to the invention. The plates all had dimensions of 10 cm by 20 cm. Before phosphating, they were degreased with a commercially available mildly alkaline cleaner (Ridoline® 1250 I, a product of Henkel KGaA, Düsseldorf). The no-rinse treatment was simulated by pouring the treatment solution into a paint thrower (Model 4302 of Lau GmbH) and applying it at 550 r.p.m. A wet film coating of about 6 ml/m$^2$ was formed in this way. After the treatment solution had been applied for about 5 seconds, the plates were immediately dried for about 120 seconds in a recirculating air drying cabinet heated to 75° C.

The coating weight was determined as the parameter for the phosphate coating obtained. Two different methods were used for this purpose. To determine the weight of the coating by weighing out, the plate was weighed before coating, the phosphating solution was applied and dried and the coated plate was reweighed. The coating weight in g/m$^2$ was calculated from the weight difference. To determine the weight of the coating by dissolution, the phosphated plates were weighed, the phosphate coating was removed by dissolving with 0.5% by weight chromic acid solution and the plates were reweighed. The weight of the coating removed in g/m$^2$ was determined from the weight difference. The coating weight determined by dissolution is generally higher than that determined by weighing out because the phosphating process converts part of the metal surface into metal phosphate. This part is not included in determination of the coating weight by weighing out, but is removed with the coating where coating weight is determined by dissolution.

Table 1 contains phosphating baths for electrolytically galvanized steel and the coating weights obtained while Table 2 contains corresponding Examples for the treatment of hot-dip-galvanized steel. Phosphating solutions which lead to coating weights of 1 to 3 g/m$^2$ are suitable for the treatment of these substrates. In the treatment baths of the Examples, zinc was used as oxide, manganese and nickel as carbonate and fluoride as sodium fluoride. Apart from water, the baths contained no other components.

For Example 20, the composition of the coating was determined in % by weight by EDX (X-ray emission): Zn 7.5, Mn 2.2, P 7.5, Al 0.3, remainder: may be recorded as oxygen.

A selection of Z plates treated in accordance with the invention was subjected, as in practice, to conventional automotive rephosphating by a commercial trication phosphating process (Granodine® 1994, a product of Henkel KGaA, Düsseldorf) and painted with a cathodic electrocoating paint (Aqualux® K, a product of IDAC). After a corrosion test (10 cycles of alternating climate according to VDA 621 415), the creepage of rust beneath the lacquer at a cut was measured in accordance with DIN 53167. The following results were obtained:

| | |
|---|---|
| Example l9 | 1.9 mm |
| Example 20 | 2.2 mm |
| Example 22 | 2.4 mm |
| Example 24 | 2.3 mm |

TABLE 1

No-rinse Phosphating of Electrolytically Galvanized Steel

| Ex. No. | Bath Composition [g/l ] | Active Substance [% by weight] | pH | Free Acid [points] | Total Acid [points] | Coating Weight[1)] [g/m$^2$] |
|---|---|---|---|---|---|---|
| 1 | 210 $H_3PO_4$ 85%<br>15 Zn<br>20 Mn | 21.4 | 1.5 | 65 | 303 | 1.57 (W) |
| 2 | 105 $H_3PO_4$ 85%<br>7.5 Zn<br>10.0 Mn | 10.7 | 2.5 | | | 0.40 (W) |
| 3 | 210 $H_3PO_4$ 85%<br>15 Zn<br>10 Mn | 21.4 | 2.4 | 31 | 281 | 1.75 (W) |
| 4 | 140 $H_3PO_4$ 85%<br>10.0 Zn<br>13.3 Mn | 14.2 | 2.5 | | | 0.90 (W)<br>1.62 (D) |
| 5 | 175 $H_3PO_4$ 85%<br>12.5 Zn<br>16.6 Mn | 17.8 | 2.5 | 29 | 228 | 1.34 (W)<br>1.96 (D) |
| 6 | 140 $H_3PO_4$ 85%<br>10.0 Zn<br>13.3 Mn | 14.2 | 2.2 | | | 0.76 (W)<br>1.47 (D) |
| 7 | 140 $H_3PO_4$ 85%<br>10.0 Zn<br>13.3 Mn | 14.2 | 2.1 | | | 0.81 (W)<br>1.35 (D) |
| 8 | 110 $H_3PO_4$ 85%<br>7.5 Zn<br>10.0 Mn<br>2.5 Ni | 11.4 | 2.5 | 27 | 190 | 1.24 (D) |
| 9 | 110 $H_3PO_4$ 85%<br>7.5 Zn<br>10.0 Mn<br>2.5 Ni<br>10.0 tartaric acid | 12.4 | 3.0 | | | 1.73 (D) |
| 10 | 110 $H_3PO_4$ 85%<br>7.5 Zn<br>10.0 Mn<br>2.5 Ni<br>20.0 tartaric acid | 13.4 | 3.5 | | | 2.05 (D) |
| 11 | 100 $H_3PO_4$ 85%<br>6 Zn<br>8 Mn<br>1 fluoride<br>10 tartaric acid | 11.0 | 3.0 | | | |
| 12 | 110 $H_3PO_4$ 85%<br>6 Zn<br>8 Mn<br>15 tartaric acid | 11.4 | 3.2 | | | 1.44 (D) |
| 13 | 210 $H_3PO_4$ 85%<br>15 Zn<br>20 Mn | 21.4 | 2.2 | | | 1.8 (D) |
| 14*) | 210 $H_3PO_4$ 85%<br>15 Zn<br>20 Mn | 21.4 | 2.2 | | | 1.8 (D) |

[1)]W: determined by weighing out D: determined by dissolution

*)In Example 14, the plate was activated for 5 seconds before phosphating by immersion in an activating bath based on titanium phosphate (Fixodine ® 950, Henkel KGaA, 0.3% in deionized water) and dried for 2 minutes at 75° C.

TABLE 2

No-rinse Phosphating of Hot-dip-galvanized Steel

| Ex. No. | Bath Composition [g/l] | Active Substance [% by weight] | pH | Free Acid [points] | Total Acid [points] | Coating Weight[1)] [g/m$^2$] |
|---|---|---|---|---|---|---|
| 15 | 280 $H_3PO_4$ 85%<br>20 Zn<br>20 Mn | 27.8 | 1.3 | 81 | 365 | 0.73 (W) |
| 16 | 560 $H_3PO_4$ 85%<br>40 Zn<br>40 Mn | 55.6 | 0.6 | | | 7.15 (W) |
| 17 | 328 $H_3PO_4$ 85%<br>24.0 Zn<br>23.4 Mn | 32.6 | 1.1 | | | 2.72 (W) |
| 18 | 305 $H_3PO_4$ 85%<br>22.0 Zn<br>21.1 Mn | 33.3 | 1.2 | | | 2.57 (W) |
| 19 | 210 $H_3PO_4$ 85%<br>15.3 Zn<br>15.0 Mn | 20.9 | 1.4 | 73 | 294 | 1.50 (W) |
| 20 | 210 $H_3PO_4$ 85%<br>15 Zn<br>20 Mn | 22.0 | 1.5 | 65 | 303 | 1.8 (W) |
| 21 | 301 $H_3PO_4$ 85%<br>15 Zn<br>15 Mn<br>1 fluoride | 28.7 | 1.0 | | | 2.63 (W) |
| 22 | 221 $H_3PO_4$ 85%<br>15 Zn<br>15 Mn<br>5 Ni | 22.3 | 1.5 | 67 | 321 | 1.55 (W) |
| 23 | 268 $H_3PO_4$ 85%<br>12 Zn<br>12 Mn<br>0.8 fluoride | 25.2 | 1.0 | | | 2.10 (W) |
| 24 | 241 $H_3PO_4$ 85%<br>10.8 Zn<br>10.8 Mn<br>0.7 fluoride | 22.7 | 1.1 | | | 1.46 (W) |
| 25 | 240 $H_3PO_4$ 85%<br>20 Zn<br>1 fluoride | 23 | 1.1 | | | 1.58 (W) |

[1)]See Table 1

TABLE 3

No-rinse Phosphating of Cold-rolled Steel (ST1405)

| Ex. No. | Bath composition [g/l ] | Active Substance [% by weight] | pH | Coating Weight[1)] [g/m$^2$] |
|---|---|---|---|---|
| 26 | 80 $H_3PO_4$ 85%<br>8 Zn<br>8 Mn<br>40 citric acid | 12.4 | 3.0 | 1.4 (D) |
| 27 | 74 $H_3PO_4$ 85%<br>7.4 Zn<br>7.4 Mn<br>52 citric acid | 13 | 3.5 | 2.1 (D) |
| 28 | 65 $H_3PO_4$ 85%<br>10 Zn<br>5 Mn<br>5 Fe(II)<br>100 citric acid | 17.5 | 4.0 | 1.5 (W) |
| 29 | 100 $H_3PO_4$ 85%<br>10 Zn<br>10 Mn<br>50 citric acid<br>3 hydroxylamine | 15.8 | 3.0 | 2.3 (D) |
| 30 | 70 $H_3PO_4$ 85%<br>7 Zn<br>7 Mn<br>28 citric acid<br>3 hydroxylamine | 10.5 | 3.5 | 1.8 (D) |

[1)]See Table 1

We claim:

1. In a process for phosphating a surface of steel, zinc, aluminium or their alloys by treatment with an acidic, zinc- and phosphate-containing solution and drying the surface without rinsing, the improvement which comprises: contacting the surface with a phosphating solution containing 2 to 25 g/l of zinc ions, 2 to 25 g/l of manganese ions and 50 to 300 g/l of phosphate ions and having a pH value of 1 to 3.6, a free acid content of 0 to 100 points, a total acid content of 40 to 400 points and a ratio of free acid to total acid not greater than 1:4.

2. The process as claimed in claim 1, wherein the phosphating solution additionally contains at least one of the following components:

(a) at least one divalent metal ion selected from the group consisting of
Ni, Co, Ca, Mg in a quantity of 0.1 to 15 g/l,
copper in a quantity of 3 to 200 mg/l,
iron in a quantity of 0.01 to 5 g/l;

(b) 0.01 to 5 g/l of fluoride in free or complexed form; and (c) 0.1 to 100 g/l of a chelating hydroxycarboxylic acid containing 3 to 6 carbon atoms.

3. The process as claimed in claim 1 wherein the phosphating solution is at a temperature of 15° C. to 80° C.

4. The process as claimed in claim 1 wherein the phosphating solution has an active substance content of from 5.5% to 35% by weight of the solution.

5. The process as claimed in claim 1 wherein the solution is applied to the surface of a moving metal strip.

6. The process as claimed in claim 1 wherein the phosphating solution is sprayed onto the surface to be phosphated at a liquid film coating of 2 to 10 ml/m$^2$.

7. The process as claimed in claim 1 wherein the phosphating solution is applied to the surface to be phosphated by applicator rolls at a liquid film coating of 2 to 10 ml/m$^2$.

8. The process as claimed in claim 1 wherein the surface to be phosphated is immersed in the phosphating solution and, after leaving the phosphating solution, a liquid film coating of 2 to 10 ml/m$^2$ is formed on the surface.

9. The process as claimed in claim 1 for treating the surface of a strip of hot-dip-galvanized steel, wherein the phosphating solution has an active substance content of 5.5% to 35% by weight; and at least one of
a pH value of 1.0 to 2.2; and
a ratio by weight of a sum of divalent metal ions to phosphate of 1:5 to 1:6.

10. The process as claimed in claim 1 for treating the surface of a moving strip of electrolytically galvanized steel, wherein the phosphating solution has an active substance content of from 5.5% to 20% by weight of the solution, and at least one of
a pH value of 1.5 to 3.5 and
a ratio by weight of a sum of divalent metal ions to phosphate of 1:5 to 1:6.

11. The process as claimed in claim 1 for treating a surface of cold-rolled ungalvanized steel, wherein the phosphating solution has an active substance content of from 5.5% to 25% by weight of the solution, and the solution has at least one of a pH value of 2.0 to 3.6 and
a ratio by weight of a sum of divalent metal ions to phosphate of 1:2.5 to 1:6.

12. The process as claimed in claim 1 wherein the drying is carried out at a temperature of 50° C. to 120° C., and the time elapsing between the first contact of the surface with the phosphating solution and the end of the drying step is from 3 to 60 seconds.

13. The process as claimed in claim 1 wherein a crystalline or X-ray-amorphous, zinc-containing, phosphate coating with a coating weight of 0.3 to 3 g/m$^2$ is formed.

14. The process as claimed in claim 2 wherein the phosphating solution is at a temperature of 15° C. to 80° C.

15. The process as claimed in claim 2 wherein a percent of active substances in the phosphating solution is from 5.5% to 35% by weight.

16. The process as claimed in claim 3 wherein a percent of active substances in the phosphating solution is from 5.5% to 35% by weight.

17. The process as claimed in claim 14 wherein a percent of active substances in the phosphating solution is from 5.5% to 35% by weight.

18. The process as claimed in claim 1 wherein the ratio of free acid to total acid is from 1:4 to 1:20.

19. The process as claimed in claim 2 wherein the ratio of free acid to total acid is from 1:4 to 1:20.

* * * * *